United States Patent [19]

Rutter

[11] 4,322,018

[45] Mar. 30, 1982

[54] FLUID DISPENSER

[76] Inventor: Christopher C. Rutter, 24174 Dover La., Hayward, Calif. 94541

[21] Appl. No.: 141,068

[22] Filed: Apr. 17, 1980

[51] Int. Cl.[3] ..... B67B 7/24

[52] U.S. Cl. ..... 222/83; 222/90; 222/105; 222/107; 222/519

[58] Field of Search ..... 222/105, 80, 81, 83, 222/90, 107, 519, 537

[56] References Cited

U.S. PATENT DOCUMENTS

| | | | |
|---|---|---|---|
| 2,751,119 | 6/1956 | Manning, Sr. | 222/81 |
| 3,173,579 | 3/1965 | Curie et al. | 222/105 |
| 3,206,075 | 9/1965 | Scholle | 222/105 |
| 3,223,117 | 12/1965 | Curie et al. | 222/183 X |
| 3,239,104 | 3/1966 | Scholle | 222/81 |
| 3,252,634 | 5/1966 | Scholle | 222/105 X |
| 3,642,172 | 2/1972 | Malpas | 222/90 |
| 4,201,208 | 5/1980 | Cambio, Jr. | 222/83 X |

*Primary Examiner*—Allen N. Knowles
*Attorney, Agent, or Firm*—Linval B. Castle

[57] ABSTRACT

A fluid dispenser for a bulk container of the type having a rigid outer box with a sealable flexible plastic inner bag. The dispenser includes a tubular sleeve having a flange that is heat-sealed to the outer surface of the plastic bag and a tubular turncock having a pointed inner end for piercing the bag of fluid. Extending from the tubular surface of the turncock barrel are keys that engage keyways in the bore of the tubular sleeve that both restrict longitudinal movement of the turncock to prevent removal or bag-piercing during storage and shipping and also, after the turncock is fully inserted to pierce the bag, restricts rotational movement of the turncock to prevent accidental removal and possible leakage. A second embodiment of the invention replaces the turncock with a conduit having the keys and the pointed tip, but with a tube fitting at the opposite end for dispensing the fluid at a remote valve or pump.

9 Claims, 12 Drawing Figures

FLUID DISPENSER

BRIEF SUMMARY OF THE INVENTION

This invention relates to bulk fluid containers and particularly to a novel fluid dispenser for small bulk containers comprising a relatively rigid outer box of corrugated paper board, or the like, and a flexible sealed fluid-containing inner bag of plastic, or the like.

Bulk containers of this type are especially valuable for the shipping and storage of fluids that may become contaminated or otherwise deteriorated when exposed to an oxidizing atmosphere. In general, such bulk containers employ a dispenser having a flange that is attached to a bag made of a flexible plastic material that will not deleteriously affect the fluid. The bag is then filled, sealed, and placed in an outer supporting box of corrugated cardboard or the like as described in U.S. Pat. No. 2,981,443 to Baldwin. If properly filled and sealed, the bag will contain no air that may damage the fluid during storage. When ready for use, a dispenser having a sharply pointed inner tip, is inserted into the flange to pierce the plastic bag and to provide a valved dispenser for the fluid as described in U.S. Pat. No. 3,239,104 to Scholle, and U.S. Pat. No. 3,642,172 to Malpas.

During shipment of the containers the dispenser is preferably attached to the bag to prevent its loss as described in U.S. Pat. No. 3,223,117 to Curie et al. This form of dispenser can obviously not be the bag-piercing type if there is a danger of an accidental piercing and loss of fluid during shipment. The piercing-type of dispenser must therefore be shipped or packaged separately and thus may be damaged or lost.

The dispenser described and claimed herein is of the bag piercing type but contains means permitting it to be safely carried within its supporting sleeve that is sealed to the inner bag, without the possibility of the pointed tip piercing the bag during shipment or rough handling of the bulk fluid container.

Briefly described, the dispenser includes a tubular sleeve member that is open on both ends but has, on one end, a flange that is heat-sealed or otherwise attached to the outer surface of a fluid containing plastic bag. A short external section of the normally circular cross-sectioned sleeve that is adjacent the flange is provided with parallel vertical sides, or it may be squared to fit into a keyhole-shaped slot in the outer container for preventing rotation of the sleeve while the dispenser is in use.

Insertable within the bore of the sleeve member is a fluid conduit which may be either a turncock or a straight tubular section with a flexible tubing connector for use in dispensing the fluid from a remote tap or external pump. In both embodiments, the fluid conduit has a bag-piercing pointed tip, and adjacent the pointed end are two or more small tabs or keys that extend radially from the surface. These keys engage slots within the bore of the outer sleeve member. In a first, or locking slot, the keys prevent longitudinal movement of the conduit and prevent the pointed end from piercing the bag. The bag becomes pierced as the conduit keys are moved into a second slot which contains restrictions that enable the turncock to be rotated between OFF and ON fluid dispensing positions without any longitudinal movement of the turncock that may cause leakage in the dispenser.

There are several important advantages in the dispenser. Substantially no air is admitted to the inner bag when opened by the piercing dispenser and the contents cannot therefore become oxidized. Because the dispenser is attached to the bag, the problem of spills and leakage is eliminated during the piercing of the inner bag. There is a substantial savings of labor during packaging of the bag contents, since the bag does not need to be attached to the outer container nor is the dispenser stored separately so that only one assembly is shipped: A box or carton containing a leakproof bag of fluid together with a simple fluid dispenser which, because it is formed of only two components, is inexpensive, reliable, easy to produce, and very simple to operate.

DESCRIPTION OF THE DRAWINGS

In the drawings that illustrate the preferred embodiments of the invention.

DETAILED DESCRIPTION

Figure 1:
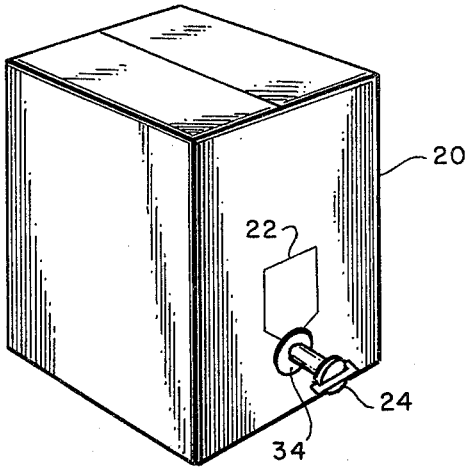
FIG. 1 is a perspective view of the outer container with a turncock dispenser fitted therein.

Illustrated in the perspective view of FIG. 1 is a container 20 of corrugated paperboard or similar materials having a suitable bursting strength to support a sealed inner container of a suitable plastic material containing a liquid. One side surface of the container 20 is its front surface and near the lower end of the front surface is a keyhole-shaped flap 22 scored through the wall of the container so that it may be lifted to expose a fluid dispenser 24 which is within the container 20 as illustrated in FIG. 2.

Figure 2:
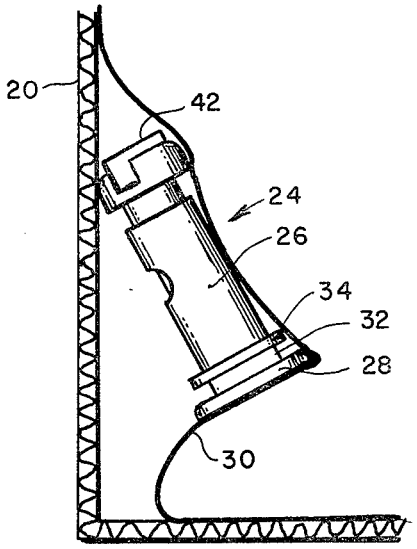
FIG. 2 is a sectional side elevation view of a portion of the container illustrating the turncock in its locked shipping and storage position.
Figure 3:
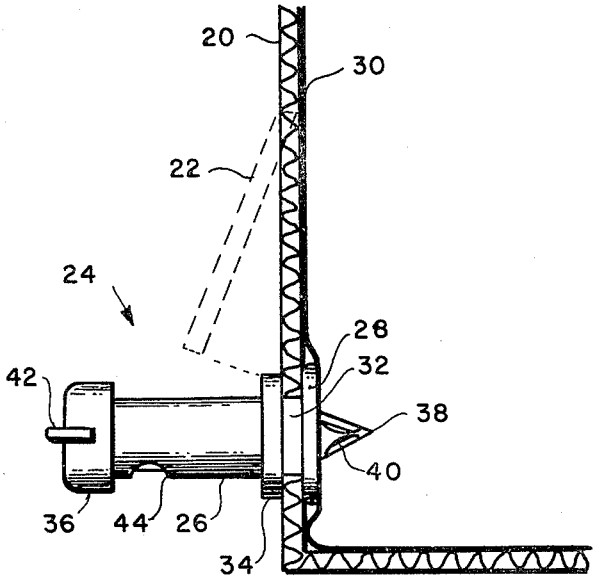
FIG. 3 is a sectional side elevation view of a portion of the container illustrated in FIG. 2 with the turncock fitted in the outer container slot and with the inner container pierced.

As best illustrated in FIG. 2, the fluid dispenser 24 includes a tubular sleeve 26 having at one end a flange 28 which is preferably heat-sealed to the outer surface of the sealed plastic bag inner container 30. As will be subsequently explained in greater detail, the exterior surface of the sleeve 26 that is adjacent the flange 28 preferably has a square cross-section and adjacent the square section 32 is a second annular flange 34. Therefore, the fluid dispenser 24 which is within the container 20 and behind the flap 22 during storage and shipping of the container is removed by lifting the flap 22 of FIG. 1, easing the dispenser 24 through the keyhole-shaped opening and positioning the square section 32 into the squared bottom of the keyhole-shaped opening as illustrated in FIG. 1 and FIG. 3. When the fluid dispenser 24 is locked into the keyhole-shaped opening in the outer container 20, the conduit core or turncock 36 may be further inserted through the tubular sleeve 26 so that a pointed end 38 of the conduit 36 will pierce the inner container bag 30 so that openings 40 in the end of the conduit 36 adjacent the pointed end 38 will admit the contents of the plastic bag 30 into the bore of the conduit. The conduit or turncock 36 is sealed at the end distal the pointed end 38 and may be provided with a suitable butterfly handle 42 to permit the turncock 36 to be turned within the tubular sleeve 26 and to align a radial hole in the wall of the conduit 36 with a similar radial hole 44 through the wall of the tubular sleeve 26 to thereby dispense the fluid from the bag 30 and through the dispenser 24.

Figure 4:
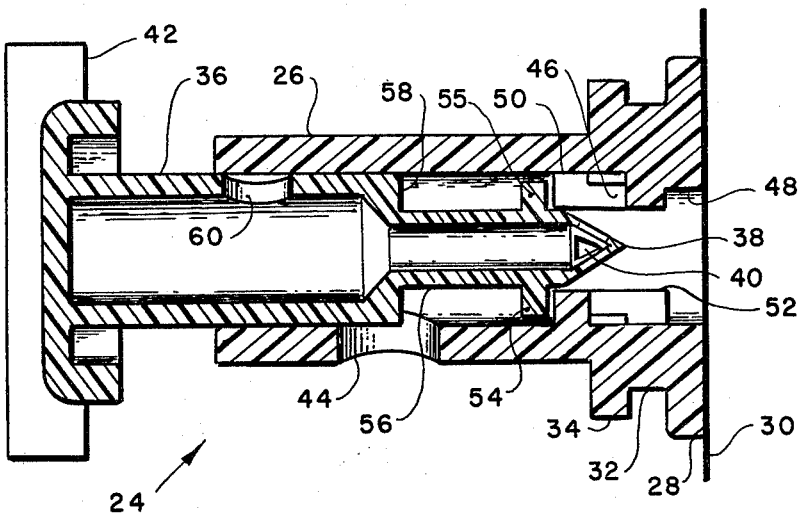
FIG. 4 is a sectional side view of the turncock with its keys positioned outside of the locking channel in the sleeve.

The structure of the dispenser 24 is illustrated in greater detail in the sectional view of FIG. 4 which illustrates the tubular sleeve 26 with its flange 28 preferably heat-sealed to the plastic fluid bag 30. The bore of the tubular sleeve 26 has a normal diameter suitable for receiving the barrel of the turncock 36 in such a manner that the turncock 36 may be rotated within the bore of the sleeve 26 but with a sufficiently small tolerance to prevent the seepage of fluid through the interface. The bore of the sleeve 26 is provided with a first annular channel 46 and second annular channel 48. Channels 46 and 48 are formed by annular walls 50 between channel 46 and the main bore portion of the sleeve 26, and also by wall 52 separating the channels 46 and 48. The walls 50 and 52 are ring-like and have a central bore of a smaller diameter than that of the main bore of the sleeve 26. As will be subsequently explained in connection with FIGS. 5 through 11, the walls 50 and 52 contain longitudinal keyway slots to permit the passage of small resilient radial tabs or keys 54 and 55 to enter various locations in the channels 46 and 48.

Keys 54 and 55 radially extend from the surface of the barrel of the turncock 36 and in a portion of smaller diameter that corresponds generally to the inside diameter formed by the walls 50 and 52 in the bore of the sleeve 26. The narrow diameter section 56 of the turncock 36 is separated from the main or larger barrel of the turncock 36 by an abrupt radial wall 58 which, as will be subsequently explained, acts as a stop against the wall 50 to limit further insertion of the turncock within the sleeve 26. Thus, when the radial stop 58 contacts the wall 50, and also when the handle 42 is against the outer end of the sleeve 26, the pointed tip 38 will have pierced the plastic bag 30 so that the fluid contained in the bag will pass through the openings 40 into the bore of the turncock 36. If the butterfly handle 42 is adjusted so that the radial hole 44 in the sleeve 26 becomes aligned with a similar radial hole 60 in the wall of the turncock 36, the fluid entering the bore of the turncock will be dispensed.

Figure 5:
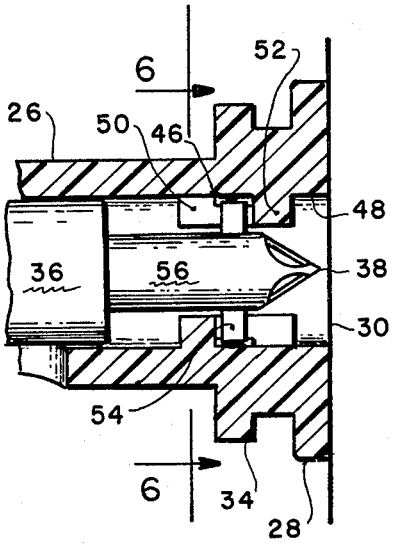
FIG. 5 is a sectional view illustrating the turncock or conduit keys located in the locking channel in the sleeve.
Figure 6:
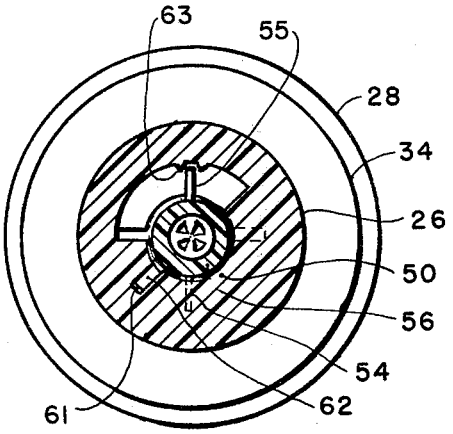
FIG. 6 is a cross-section view taken along the lines 6—6 of FIG. 5.

FIGS. 5 and 6 are sectional views of a portion of the dispenser of FIG. 4 illustrating the turncock or conduit 36 extending deeper into the bore of the tubular sleeve 26. Conduit 36 has been rotated one-eighth turn and the key 54 has been urged over a small annular protrusion 61 in the keyway 62 thus forcing keys 54 and 55 into the channel 46 formed between walls 50 and 52. The conduit 36 has then been rotated back about one-eighth turn so that keys 54 and 55 are shown in a vertical position between pairs of small protrusions 63 that restrict free movement of the resilient keys within the channel 46. It can be seen that the pointed tip 38 at the end of the small diameter barrel 56 of the conduit 36 does not come in contact with the surface of the plastic inner container bag 30 so that, as long as keys 54 and 55 remain between the protrusions 63 in channel 46, the bag 30 cannot be pierced. As will be subsequently described, the next keyway between channels 46 and 48 is substantially at right angles to the plane of the vertical positioned keys 54 and 55 in channel 46. Therefore, in order for the keys 54 and 55 to pass from channel 46 into the next channel 48, the conduit 36 must be rotated approximately 90°. It can be seen, therefore, that with the keys 54 and 55 within the protrusions 63 in the channel 46 after having been rotated about one-eighth turn after passing through the keyways 62, the key 54 will prevent removal of the conduit 36 from the sleeve, and the key 55 will prevent further insertion of the conduit into the sleeve 26. This is the locked position into which the conduit is placed during shipping and storage of the bulk container 20.

Figure 7:
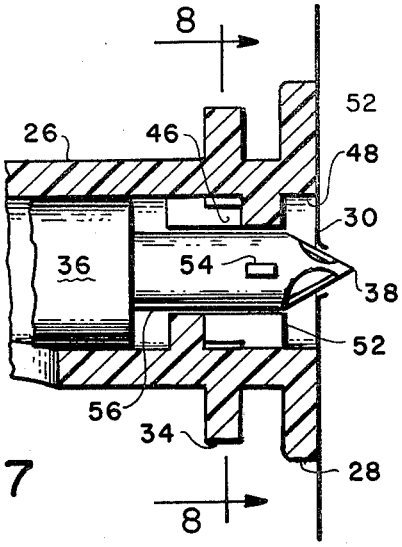
FIG. 7 is a cross-sectional view illustrating the conduit or turncock keys located in an interchannel slot to permit the piercing of the inner container.
Figure 8:
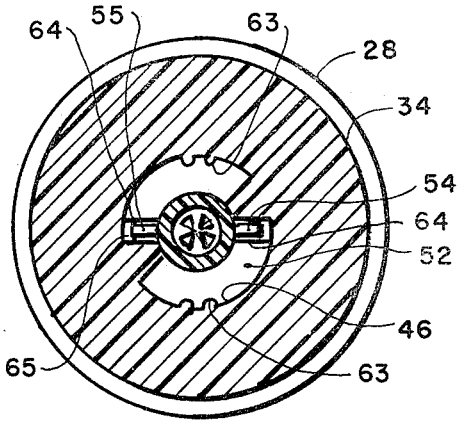
FIG. 8 is a cross-section view taken along the lines 8—8 of FIG. 7.

FIGS. 7 and 8 illustrate the conduit 36 further inserted into the bore of the tubular sleeve 26 so that the pointed end 38 now pierces the plastic liquid container bag 30. The keys 54 and 55 are located in the horizontal keyways 64 through the wall 52 and the resilient keys 54 and 55 have not yet been urged into the channel 48 over a pair of annular protrusions 65 in the keyways 64 that restrict free movement to and from the second channel 48.

Figure 9:
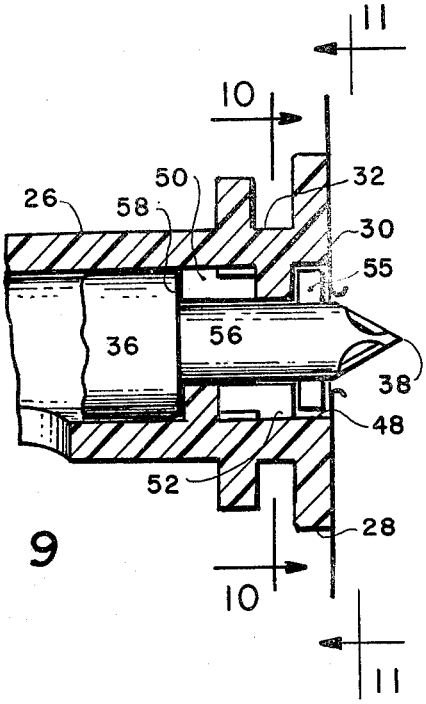
FIG. 9 is a cross-section view illustrating the conduit or turncock keys in a second channel and in operating position.
Figure 10:
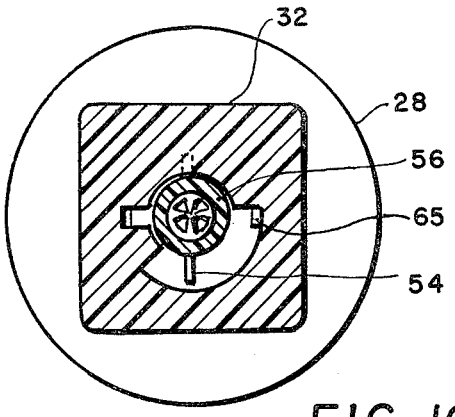
FIG. 10 is a cross-section view taken along the lines 10—10 of FIG. 9.
Figure 11:
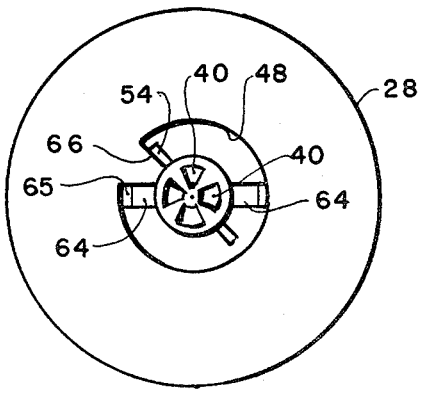
FIG. 11 is an end elevation view taken along the lines 11—11 of FIG. 9.

FIGS. 9, 10 and 11 illustrate the conduit 36 fully inserted through the bore of the sleeve 26 with the keys 54 and 55 in the second channel 48 and vertically rotated away from the horizontal keyway 64. The radial stop 58 between the main body of conduit 36 and the small diameter barrel 56 now rests against the wall 50 so that the turncock or conduit 36 cannot be inserted further. The key 55 in its vertical position rests against the side of wall 52 to prevent extraction of the conduit 36 from the bore of the sleeve 26. The conduit 36 is therefore longitudinally locked, has fully pierced the plastic bag 30, and is in its normal dispensing position.

FIG. 11 is an elevation view taken along the lines 11—11 of FIG. 9 and illustrates in detail the configuration of the channel 48. Channel 48 preferably is formed by two coplanar sections, one being semicircular and extending between the horizontal keyways 64 and the second having an arcuate path of less than 180° and preferably, in the order of 135°, as illustrated, extending from one horizontal keyway 64 to a stop 66 for the key 54. If the key 54 abuts the stop 66, the dispensing holes 44 and 60 of FIG. 4 will be in alignment so that the dispenser is in its ON position. Rotation to any location between stop 66 and the entrance keyways 64 to the channel 48 will shut off the dispenser. The conduit 36 is not easily removed, however, since the protrusions 65 in the keyway 64 restrict removal of keys 54 and 55 from the channel 48.

Figure 12:
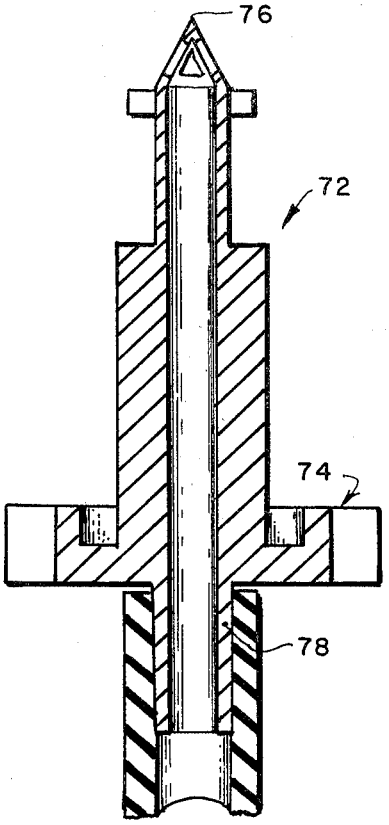
FIG. 12 is a sectional view of a tubular conduit having a tubing connection for remote dispensing.

FIG. 12 is a sectional view of another embodiment of a conduit inserted into the tubular sleeve of the fluid dispenser. That portion of the conduit 72 between the butterfly handle 74 and the pointed tip 76 is identical in all respects with the turncock described in connection with FIG. 4 except that the wall of the conduit 72 is solid, containing no radial dispensing holes such as the hole 60 of FIG. 4. The bore of the conduit 72 extends through the handle portion and into a tubing connector 78 so that the conduit may be used to tap the bulk container of fluid and dispense the fluid at some remote location either by gravity to a spigot or through a pump which will completely exhaust all fluid from the plastic bag. In the embodiment employing an external pump, the plastic bag may be used for the storage and dispensing of toxic or flammable liquids or those which may be subject to combustion or deterioration upon exposure to the particular environment in which the dispensing equipment is employed.

It will be appreciated that in the dispenser described herein, the turncock and sleeve member are included within the rigid outer container and are stored and shipped as a complete unit. If the ultimate user of the bulk container so desires, he may remove the turncock by reversing the normal assembly procedures prior to the piercing of the bag of fluid, and replace the turncock with the tubing fitted conduit of FIG. 12. This conduit may, if desired, be connected to similar conduits via a dispensing manifold or may be used singly to transport the fluid to another dispensing location.

Having thus described my invention, what is claimed is:

1. In combination with a bulk container having a rigid outer container and a flexible sealable inner container for the storage of liquids, a fluid dispenser comprising:

a tubular sleeve member having at a first end a radial flange adhesively sealed to the external surface of said inner container, said sleeve member being open at its second end; and a tubular conduit member within said tubular sleeve member, said conduit member having its external surface in a leakage-free rotatable fit within the bore of said sleeve member and extending from the second end thereof, the first end of said conduit member having a pointed tip for piercing said inner container and at least one opening for admitting liquid from said container into the bore of said conduit member, the surface of said tubular conduit member adjacent said first end having radially extending keys adapted to fit keyways and key channels within the bore of said tubular sleeve member for restricting particular movements of said conduit member within said sleeve member.

2. The fluid dispenser claimed in claim 1 wherein said tubular sleeve member has, adjacent its first end, a plurality of circumferential channels formed in its bore by tubular ring sections of smaller inside diameter than that of the bore of said sleeve, each of said channels being interconnected by keyway slots parallel with the axis of said sleeve member, said keyway slots between adjacent channels being non-aligned with each other, and wherein said conduit member has adjacent its first end, a tubular portion of reduced diameter for extending through the channeled bore of said sleeve member, said conduit further having a plurality of keys extending radially from said reduced diameter portion, said keys adapted to pass through said keyway slots upon rotation of said conduit member, the first of said channels distal of said first end of said sleeve member providing a longitudinal restriction to said keys when said keys are non-aligned with any of said keyway slots, said restriction preventing the removal of said conduit member from said sleeve and also preventing the piercing of said inner container by said pointed tip.

3. The fluid dispenser claimed in claim 2 wherein said channel distal said first end contains at least one pair of longitudinal protrusions extending from the floor of said channel, said pair being separated from each other by the approximate thickness of said keys and positioned between keyways for providing rotational resistance to said conduit when said keys are located between the protrusions of said pair.

4. The fluid dispenser claimed in claim 3 wherein a second channel between said first channel and said first end of said sleeve member includes stop means for limiting the rotation of said keys in said second channel to an angle substantially greater than 90° and less than 180°.

5. The fluid dispenser claimed in claim 4 wherein the end of the tubular body portion of said conduit adjacent said tubular portion of reduced diameter of said conduit is rotatable against the external wall of the first of said circumferential channel distal of said first end of said sleeve member when said keys are positioned in said second channel, whereby longitudinal movement of said fluid conduit in said sleeve member is prevented.

6. The fluid dispenser claimed in claim 5 wherein the second end of said conduit includes a tubing connector.

7. The fluid dispenser claimed in claim 5 wherein said conduit is a turncock.

8. The fluid dispenser claimed in claims 6 or 7 wherein said conduit is readily withdrawn from said sleeve member prior to the piercing of said inner container for replacement with a different one of said conduits.

9. The fluid dispenser claimed in claims 1, 2, 3, 4 or 5 wherein said tubular fluid conduit is a turncock, the rotation of which between an OFF and ON position aligns a radial dispensing hole through the wall of said turncock with a corresponding radial hole through the wall of said tubular sleeve member.

* * * * *